United States Patent [19]

Takezawa

[11] Patent Number: 4,559,515

[45] Date of Patent: Dec. 17, 1985

[54] SLIDE TYPE VARIABLE RESISTOR ASSEMBLY AND METHOD OF PRODUCING SAME

[75] Inventor: Keiji Takezawa, Miyagi, Japan

[73] Assignee: Alps Electric Co., Ltd., Japan

[21] Appl. No.: 648,887

[22] Filed: Sep. 10, 1984

[30] Foreign Application Priority Data

Sep. 8, 1983 [JP] Japan ..... 58-138436[U]

[51] Int. Cl.[4] ..... H01C 10/16

[52] U.S. Cl. ..... 338/128; 338/176

[58] Field of Search ..... 338/176, 171, 128, 230, 338/235, 239, 260, 295, 319, 320, 76, 120, 122, 48; 174/52 R

[56] References Cited

U.S. PATENT DOCUMENTS

| | | | |
|---|---|---|---|
| 2,221,977 | 11/1940 | Lannerd | 338/128 X |
| 3,355,694 | 11/1967 | Wolff | 338/128 X |
| 3,509,509 | 4/1970 | Rapisarda | 338/128 |
| 3,883,840 | 5/1975 | Dornen et al. | 338/128 |
| 4,005,381 | 1/1977 | Klug | 338/183 X |
| 4,131,870 | 12/1978 | Hilgendorf et al. | 338/176 X |

*Primary Examiner*—C. L. Albritton
*Assistant Examiner*—M. M. Lateef
*Attorney, Agent, or Firm*—Guy W. Shoup; Gerard F. Dunne

[57] ABSTRACT

Disclosed is a slide-type variable resistor assembly which comprises a block of a synthetic resin material, a plurality of insulation bases integrally molded in the block, a resistor element fixedly provided on a surface of each of the insulation bases, a collector member fixedly provided on the surface of each of the insulation bases, a frame member provided on each of the insulation bases, and a slider member slidably provided between the resistor element and the frame such that the slider is slidably contacted with the resistor element as well as the collector member.

A method of producing the slide-type variable resistor assembly is also described which comprises the steps of preparing insulation bases integrally molded into a block, with holes formed through the sides of each insulation base, attaching a resistor element and a collector member on the surface of each insulation bases, and inserting legs provided on each frame into the holes and bending them to fix the frame to the block with a slider being slidably contacted with the resistor element as well as the collector member.

5 Claims, 3 Drawing Figures

SLIDE TYPE VARIABLE RESISTOR ASSEMBLY AND METHOD OF PRODUCING SAME

BACKGROUND OF THE INVENTION

1. Field of the Invention

The invention relates to a slide-type variable resistor, and particularly to a slide-types variable resistor assembly in which plural sets of variable resistors are interconnected. The present invention relates also to a method of producing the slidetype variable resistor assembly of the kind described aboe.

2. Description of Prior Art

Conventionally, in assembling plural lines of slide-type variable resistor elements into a slide-type variable resistor assembly, desired number of variable resistor elements, each of which is prepared as a completed variable resistor, are screwed onto a metal reinforcement and fixed thereto by caulking or the like. However, as the variable resistor elements fixed to the reinforcement plate increase in number, fixing screws or the like also increase. Thus, the prior art had a disadvantage that the assembling work became complicated as the variable resistor elements to be integrally assembled increase in number.

SUMMARY OF THE INVENTION

An object of the invention is to eliminate the above mentioned disadvantage in the prior art and to provide a variable resistor assembly of desired number of variable resistor elements by simple assembling work.

To attain the object, the present invention is featured in that a plurality of insulation bases are integrally molded by using a synthetic resin material. Other objects and features of the invention will be apparent from the following description taken in connection with the accompanying drawings.

DETAILED DESCRIPTION OF PREFERRED EMBODIMENT

Figure 1:
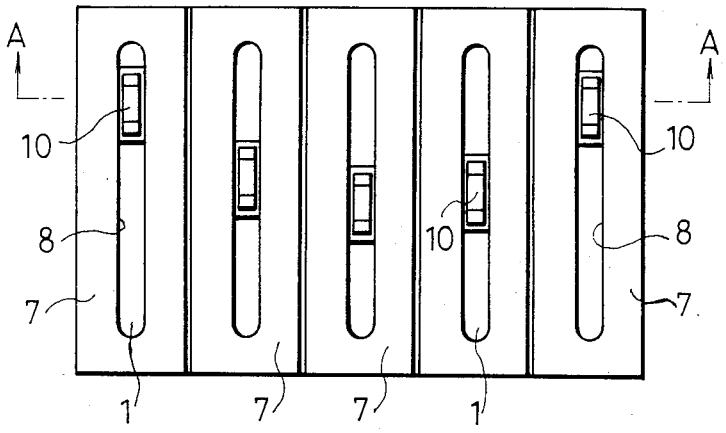
FIG. 1 is a plan view showing a slide-type variable resistor assembly of a plurality of variable resistor elements (five ones in number in the illustrated embodiment).
Figure 2:
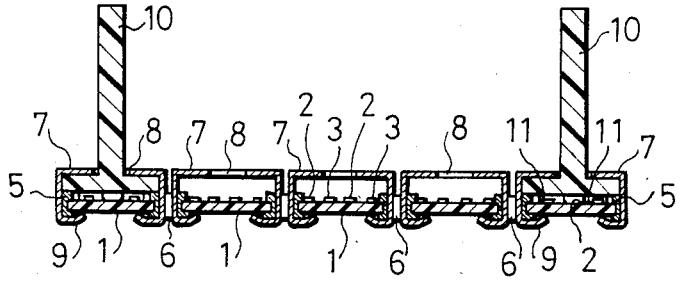
FIG. 2 is a cross-section along A—A line of FIG. 1.

Referring to the drawings, a preferred embodiment of the present invention will be described hereunder.

In the drawings, reference numeral 1 designates a rectangular insulation base made of phenolic resin or the like, for each of plural variable resistor elements to be assembled into a variable resistor assembly. Along the longitudinal direction of the insulation base 1, resistor layers 2 and collector layers 3 are alternately formed with a predetermined distance therebetween, by a printing method or the like. Reference numeral 4 designates a plane base block in which a plurality of insulator bases 1 as described above are integrally interconnected with an outside member of a synthetic resin material 5. Through holes 6 are formed in the base block 4 at the both sides of each of the insulator bases 1.

Reference numeral 7 designates a frame made of a metal plate and opened at its lower surface. An elongated slider hole 8 is formed in the upper surface of the frame 7, and a plurality of legs 9 are provided on the opposite side surfaces. The legs 9 of the frame 7 are inserted into the through holes 6 and then bent to fixedly attach the frame 7 onto the base block 4. Thus, the frames 7 of the same number as and corresponding to the insulation bases 1 are fixed onto the base block 4, such that the frames 7 are correspondingly respectively in opposition to the insulation bases 1.

Figure 3:
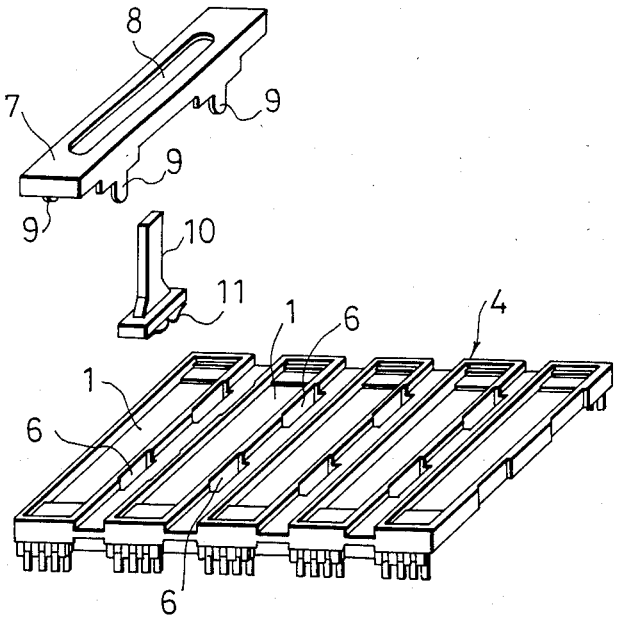
FIG. 3 is an exploded perspective view showing the state of the variable resistor assembly.

Reference numeral 10 designates an operating lever made of an insulation molding material, such as a synthetic resin material. A slider 11 is attached on the under surface of the operating lever 10 such that the slider 11 is slidably contacted with both the resistor layer 2 and the collector layer 3. The operating lever 10 is disposed between insulation base 1 and the frame 7 opposing to each other, with a part of the operating lever being outwardly projected form the slider hole 8 of the frame 7. Next, referring to FIG. 3, the assembling work will be described.

At first, the base block 4 provided with desired numbers of insulation bases 1 are prepared. The base block 4 may be prepared in such a manner as described above in which previously prepared insulation bases 1 of the desired number are integrally molded with an outside member of a synthetic material 5 or the like, or alternatively in another manner such that a previously prepared large sized base block formed with numbers of integrally molded insulation base portions is cut in use depending upon the requirements of the situation. Next, the legs 9 of each frame 7 are inserted into the through holes 6 formed at the both sides of the corresponding insulation base 1 with a portion of the operating lever 10 projected from the slider hole 8. The legs 9 are then bent. Thus, a slide-type variable resistor provided with five lines of variable resistor elements each constituted by an insulation base 1, a frame 7, and an operation lever 10 is assembled.

If the operating lever 10 is moved along the slider hole the slider 11 attached on the operating lever 10 slides on the resistor layer 2 as well as the collector 3, whereby the resistance value of one variable resistor element can be varied independently of the other ones.

As described above, since a plurality of insulation bases are integrated by molding with a synthetic material, no reinforcement plate for connecting respective variable resistor elements and no screws for fixing the respective variable resistor elements onto such a reinforcement plate is required, so that a slide-type variable resistor assembly of the desired number of variable resistor elements by simple assembling work.

What is claimed is:

1. A slide type variable resistor assembly comprising:

a block of a synthetic resin material;

a plurality of insulation bases integrally molded in said block;

resistor means fixedly provided on a surface of each of said insulation bases;

collector means fixedly provided on the surface of each of said insulation bases;

frame means provided on each of said insulation bases; and respective slider means slidably provided between said resistor means and said frame means of each said insulation base such that said slider is slidably contacted with the respective surfaces of said resistor means and said collector means.

2. A slide-type variable resistor assembly according to claim 1 in which holes are formed through said base block at the sides of each of said insulation bases, said frame means having legs integrally formed therewith and inserted into said holes at the sides of corresponding one of said insulation bases and bent to fix said frame to said base block.

3. A slide-type variable resistor assembly according to claim 1 in which said slider means is provided with an operation lever having a portion projected outwardly from a hole formed at a surface portion of said frame.

4. A method of producing a slide type variable resistor assembly comprising the steps of:

preparing a plurality of insulation bases;

integrally molding said plurality of insulation bases into a base block, said block having a plurality of holes formed therethrough at the sides of each of said insulation bases;

attaching a resistor means and a collector means onto a surface of each of said insulation bases;

placing a respective frame member onto each of said insulation bases with an operating lever held between said frame member and said insulation base with a portion of said lever projected outwardly from a hold formed at a surface of said frame; and inserting legs provided on each frame member into said holes of said base block at the sides of said corresponding insulation base and bending said legs so as to fix said frame member to said block above said corresponding insulation base, with a slider attached on said operation lever being slidably contacted with said resistor means as well as said collector means.

5. A method of producing a slide type variable resistor assembly comprising the steps of:

preparing a a block molded with a synthetic resin material and having a plurality of integrally formed insulation base portions, said block having a plurality of holes formed therethrough the sides of said insulation base portions;

attaching a resistor means and a collector means onto a surface of each of said insulation base portions;

placing a frame member onto said block above each of said insulation base portions with an operation lever held between said frame member and said insulation base portion with a portion of said lever projected outwardly from a hole formed at a surface of said frame; and inserting legs formed on each frame member into said holes of said block at the sides of said corresponding insulation portion and bending said legs so as to fix said frame member to said base block, with a slider attached on said operation lever being slidably contacted with said resistor means as well as said collector means.

* * * * *